US010029707B2

(12) United States Patent
Gibney et al.

(10) Patent No.: US 10,029,707 B2
(45) Date of Patent: Jul. 24, 2018

(54) BAFFLE

(71) Applicant: DRAX POWER LIMITED, Selby, North Yorkshire (GB)

(72) Inventors: Richard Peter Gibney, Derby (GB); David Thomas Turner, Derby (GB); Jonathan James Barlow, Derby (GB)

(73) Assignee: Drax Power Limited, Selby, Yorkshire (GB)

( * ) Notice: Subject to any disclaimer, the term of this patent is extended or adjusted under 35 U.S.C. 154(b) by 365 days.

(21) Appl. No.: 14/768,631

(22) PCT Filed: Feb. 18, 2014

(86) PCT No.: PCT/GB2014/050472
§ 371 (c)(1),
(2) Date: Aug. 18, 2015

(87) PCT Pub. No.: WO2014/128450
PCT Pub. Date: Aug. 28, 2014

(65) Prior Publication Data

US 2016/0001788 A1 Jan. 7, 2016

(30) Foreign Application Priority Data

Feb. 19, 2013 (GB) ..... 1302909.5

(51) Int. Cl.
*B61D 7/00* (2006.01)
*B61D 7/32* (2006.01)
*B61D 7/02* (2006.01)

(52) U.S. Cl.
CPC ..... *B61D 7/32* (2013.01); *B61D 7/02* (2013.01)

(58) Field of Classification Search
CPC ... B61D 7/00; B61D 7/02; B61D 7/14; B61D 7/16; B61D 7/18; B61D 7/32
See application file for complete search history.

(56) References Cited

U.S. PATENT DOCUMENTS 6,227,124 B1 * 5/2001 Gaydos ..... B61D 7/26 105/286
7,051,661 B2 * 5/2006 Herzog ..... B61D 7/02 105/286

(Continued)

FOREIGN PATENT DOCUMENTS

DE 519637 C * 3/1931 ..... B61D 7/02
DE 519637 C 3/1931

(Continued)

OTHER PUBLICATIONS

International Search Report dated Jun. 12, 2014 in connection with related International Patent App. No. PCT/GB2014/050472, 4 pages.

(Continued)

*Primary Examiner* — Jason C Smith
(74) *Attorney, Agent, or Firm* — Gesmer Updegrove LLP

(57) ABSTRACT

A baffle comprising a panel body that is mountable on a wall of a hopper adjacent to an edge of an outlet of a hopper and is arrangeable in a projecting position, to project in a generally downwardly direction beyond the edge of the outlet so as to restrict the spread of bulk commodities past the panel body as the bulk commodities discharge through the outlet. The panel body is arrangeable in the projected position to project in a generally downwardly direction beyond the edge of the outlet and between a gap space defined by the edge of the outlet and an outlet cover arranged in an open position. The baffle may comprise rotatable mounting means for rotatably mounting the panel body on the wall of the hopper such that the panel body is movable between the projected position and a retracted position, where the panel body is arranged so as to provide a minimal or no barrier effect. The baffle may comprise drive means to drive the panel body between the projected position and the extended position. The drive means may be self-actuating (Continued)

means and the self-actuating means are optionally configured to incite the rotation of the panel body between the projected position and the retracted position as the outlet cover moves between an open position and a closed position. The self-actuating means may comprise slidable coupling means for slidably coupling the panel body to the outlet cover and optionally the slidable coupling means comprise one or more low friction contact members mounted on a lower edge and/or side edge of the panel body and arranged in mating contact with the outlet cover.

17 Claims, 13 Drawing Sheets

(56) References Cited

U.S. PATENT DOCUMENTS

| | | | | |
|---|---|---|---|---|
| 8,596,203 | B2 * | 12/2013 | Forbes | B61D 7/28 105/248 |
| 8,915,193 | B2 * | 12/2014 | Bis | B61D 7/18 105/250 |
| 8,915,194 | B2 * | 12/2014 | Creighton | B61D 7/24 105/286 |
| 9,751,536 | B2 * | 9/2017 | Galvan | B61D 7/26 |
| 2012/0210906 | A1 * | 8/2012 | Gaydos | B61D 7/26 105/285 |
| 2016/0001788 | A1 * | 1/2016 | Gibney | B61D 7/02 105/247 |
| 2016/0001792 | A1 * | 1/2016 | Gibney | B61D 39/001 105/377.06 |
| 2016/0311445 | A1 * | 10/2016 | Galvan | B61D 7/26 |

FOREIGN PATENT DOCUMENTS

| | | | | |
|---|---|---|---|---|
| DE | 959103 | C | 2/1957 | |
| WO | 99/62751 | A1 | 12/1999 | |
| WO | WO-9962751 | A1 * | 12/1999 | B61D 7/28 |
| WO | 2014/128450 | A1 | 8/2014 | |

OTHER PUBLICATIONS

International Preliminary Report on Patentability dated Aug. 25, 2015 in connection with related International Patent App. No. PCT/GB2014/050472, 8 pages.

* cited by examiner

BAFFLE

PRIORITY INFORMATION

The present invention is a continuation of PCT Application No. PCT/GB2014/050472 filed Feb. 18, 2014, that claims priority to GB Application No. 1302909.5, filed on Feb. 19, 2013, both of which are incorporated herein by reference in their entireties.

FIELD OF INVENTION

The present invention relates to the discharging of bulk commodities from a hopper. The present invention is particularly concerned, although not exclusively, with the discharging of bulk commodities from a hopper wagon.

BACKGROUND TO THE INVENTION

A hopper is a chamber for storing bulk commodities such as grain, rock, coal, biomass etc. The bulk commodities are typically loaded into a hopper through an inlet aperture at the top of the chamber and discharged through an outlet aperture in the bottom of the chamber. Due to the arrangement of the outlet, bulk commodities discharge through the outlet under the force of gravity. The discharging process is controlled by using a discharge system to open and close the outlet aperture when required.

A hopper may be a free-standing container or it may be combined with other apparatus. For example, a hopper may be incorporated in a vehicle.

A hopper wagon is a type of freight railway vehicle for transporting bulk commodities. The hopper wagon comprises a hopper wagon body with a hopper chamber for storing bulk commodities. The hopper wagon body is supported by an underframe. Bogies may be coupled to the underside of the underframe to allow the hopper wagon to move along the railway track. The bulk commodities are loaded into the chamber through an inlet aperture and discharged through at least one outlet aperture. The inlet aperture is conventionally formed in the top of the hopper wagon body whilst the at least one outlet aperture is conventionally formed in the bottom of the hopper wagon body. It is customary for bulk commodities to be discharged from the chamber into an unloading bay formed in the floor between the rails and beneath the railway track. The discharging process is controlled by using a discharge system to regulate the opening and closing of the outlet aperture(s).

Conventional discharge systems typically comprise one or more closable doors that are arranged on the underside of an outlet and are movable between an open position and a closed position. For example, a prior art discharge system may comprise a pair of doors that are arranged on opposing sides of an outlet and extend the length of the outlet. Each door is pivotally mounted to allow for the rotation between a closed position and an open position. When rotated to the closed position, the doors extend across the outlet and form a sealing engagement, thereby covering the outlet such that the discharging of bulk commodities is prevented. When the doors are rotated to the open position, the outlet is uncovered such that unrestricted discharging can occur.

During the discharging process, it has been found that bulk commodities may spill or spread undesirably. For example, when discharging a hopper wagon, bulk commodities may spill laterally and/or longitudinally along the railway track and the surrounding area rather than into the unloading bay. The spillage of bulk commodities is wasteful.

The spillage of bulk commodities may impede the operation of the hopper. For example, the spillage on the railway tracks may reduce the engagement between the bogie wheels and railway track and may ultimately lead to the derailment of the hopper wagon. The spillage may obstruct the motion of the doors such that they are unable to open and close properly. The spillage may interfere with other component parts of the hopper or associated apparatus. The spillage of bulk commodities may release unwanted dust or particulates into the atmosphere. Accordingly, railway personnel must regularly inspect the railway track to remove any spillage from a hopper wagon, which is both an expensive and time consuming procedure. Given that hopper wagons may have approximately 20,000 to 30,000 loading/unloading cycles over a lifetime, the spillage of bulk commodities for hopper wagons is a significant problem.

SUMMARY OF THE INVENTION

Embodiments of the invention seek to address or counteract the problems associated with conventional hopper discharge systems as described above. The present invention seeks to provide a solution to the problem of spillage as bulk commodities are discharged through an outlet of a hopper.

The present invention is defined in the attached independent claims, to which reference should now be made. Further preferred features may be found in the sub claims appended thereto.

A first aspect of the invention relates to a baffle that can be arranged to extend from an edge of an outlet of a hopper so that it impedes the spread of bulk commodities in a direction beyond the baffle as they discharge through the outlet, and thereby control the flow of bulk commodities.

The baffle comprises a panel body that can be mounted on a wall of a hopper adjacent an edge of an outlet of a hopper and, whereby in use, the panel body can be arranged in a projecting position, to project in a generally downwardly direction beyond the edge of the outlet so as to restrict the spread of bulk commodities past the panel body as the bulk commodities discharge through the outlet.

By restricting the spread of commodities beyond (behind, to the rear of) the panel body the baffle advantageously reduces the loss of bulk commodities.

The panel body may be mountable on a sidewall of the hopper adjacent to a side edge of the outlet and, in use, may be arrangeable in the projected position to project downwardly beyond the side edge of the outlet so as to restrict lateral spread of bulk commodities past the panel body as the bulk commodities discharge from the outlet.

The panel body may be mountable on an end wall of the hopper adjacent to an end edge of the outlet and, in use, may be arrangeable in the projected position to project in a generally downwardly direction beyond the end edge of the outlet so as to restrict longitudinal spread of bulk commodities past the panel body as the bulk commodities discharge from the outlet. If the baffle is mounted in a movable hopper or hopper vehicle, the end edge may be a leading end edge or a trailing end edge.

Since the bulk commodities will only discharge when the outlet is open, the panel body is preferably arrangeable in the projected position to project in a generally downwardly direction beyond the edge of the outlet and between a gap space defined by the edge of the outlet and an outlet cover arranged in an open position.

The panel body may be arrangeable in the projected position to project at a first incline angle $\alpha$. Optionally, the first inclined angle $\alpha$ may be selected in accordance with the position of a discharge region or receptacle so that the panel body advantageously guides the discharging bulk commodities towards the discharge region or receptacle.

The baffle may comprise means for mounting the panel body on the wall of the hopper such that the panel body is movable between the projected position and a retracted position, where the panel body is arranged in a stowed configuration and provides no barrier effect. Preferably, in the retracted position, the panel body is arrangeable to extend from the hopper wall at a second incline angle $\beta$, where angle $\beta$<angle $\alpha$.

The baffle may comprise hinge means to rotatably mount the panel body on the hopper wall such that the panel body is rotatable between the projected position and the retracted position.

The baffle may comprise drive means to drive the panel body between the projected position and the retracted position. Preferably, the drive means are self-actuating means. The self-actuating means may be configured to incite the rotation of the panel body between the projected position and the retracted position as the outlet cover moves between an open position and a closed position. Hence, the panel body will be arranged for use in a projected position when the outlet door is open and the panel body will be arranged in a retracted position when the outlet door is closed. The self-actuating means may comprise slidable coupling means for slidably coupling the panel body to the outlet cover. The slidable coupling means may comprise one or more low friction contact members mounted on a lower edge and/or side edge of the panel body and arranged in mating contact with the outlet cover.

The baffle may comprise a stiffening tip arranged along a lower edge of the panel body.

A second aspect of the invention comprises a discharge system for controlling the discharge of bulk commodities through an outlet of a hopper comprising:

- an outlet cover arrangeable on the underside of the outlet and movable between a closed position, where the outlet is substantially closed and an open position, where the outlet is substantially open;
- a baffle according to the first aspect of the invention that is arrangeable, in use, to restrict the spread of bulk commodities in a direction beyond the baffle as bulk commodities discharge through the open outlet cover.

A third aspect of the invention relates to a hopper comprising:

- a chamber for storing bulk commodities;
- an inlet through which bulk commodities can be loaded into the chamber;
- an outlet through which bulk commodities can discharge from the chamber;
- an outlet cover movable between a closed position where the outlet is substantially closed and an open position where the outlet is substantially open;
- actuating means for driving the outlet cover between the closed position and the open position;
- a baffle according to the first aspect of the invention that is arrangeable, in use, to control the spread of bulk commodities as they discharge through an open outlet.

A fourth aspect of the invention relates to a hopper wagon comprising:

- hopper wagon body comprising a chamber for storing bulk commodities;
- an inlet formed in the top of the body and through which bulk commodities can be loaded into the chamber;
- at least one outlet formed in the bottom of the body and through which bulk commodities can discharge from the chamber;
- an outlet cover arranged on the underside of the or each outlet where the or each outlet cover is movable between a closed position, where the outlet is substantially closed and an open position, where the outlet is substantially open;
- actuating means for driving the or each outlet cover between the closed position and the open position;
- control means for controlling the actuating means;
- at least one baffle according to the first aspect of the invention that is arrangeable, in use, to limit the spread of bulk commodities as they discharge through the or each open outlet.

The or each outlet cover may comprise an opposing pair of doors for the outlet, whereby the opposing pair of doors are mountable on opposing walls and are rotatable between an open position where the doors are rotated to extend from the opposing walls in a generally downwardly direction and a closed position, where the doors are rotated such the distal edges of the doors engage and the outlet is thereby closed.

The actuating means may comprise a cylinder and piston and an equaliser linkage to drive the opposing pair of doors between the closed position and the open position.

The control means may be automatic control means configured to sequentially open and close the outlet covers as the respective outlets of the hopper wagon pass over an unloading bay.

BRIEF DESCRIPTION OF THE DRAWINGS

For a better understanding of the present invention and to show how it may be carried into effect, reference shall now be made by way of example to the accompanying drawings in which.

DETAILED DESCRIPTION OF THE INVENTION

The present invention relates to a baffle and its applications thereof.

The baffle is a flap-like mechanism for controlling the spread or deployment of bulk commodities as they discharge through an outlet of a hopper.

The baffle is suitable for use in any type of hopper. For example, the baffle is suitable for use in a free-standing hopper for storing bulk commodities at a particular location or a hopper combined with other apparatus. For example, the hopper may be a hopper incorporated in a vehicle for transporting bulk commodities. The vehicle may be a hopper railway wagon.

Figure 1:
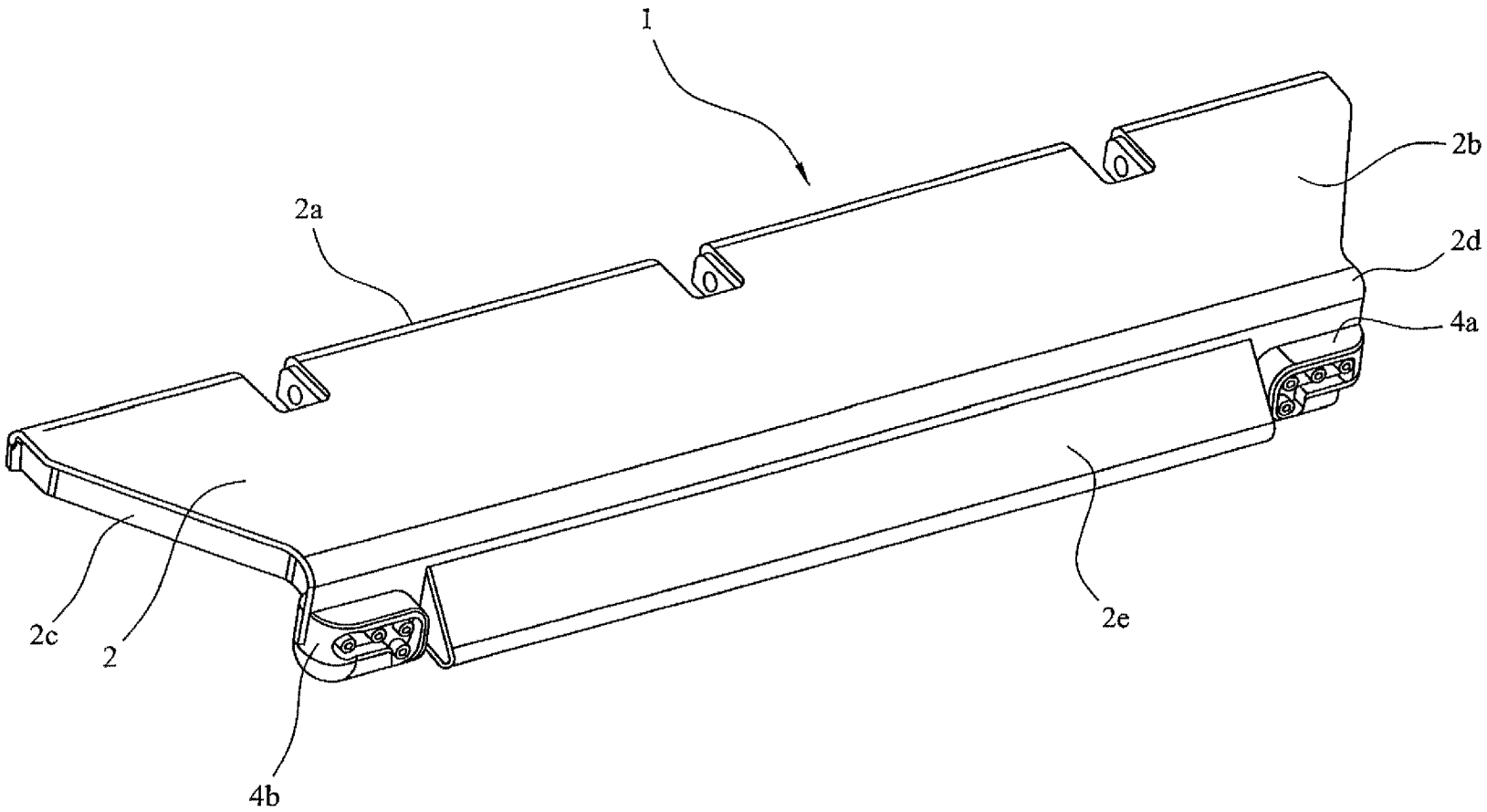
FIG. 1 depicts a perspective view of a baffle according to an embodiment of the invention.
Figure 2:
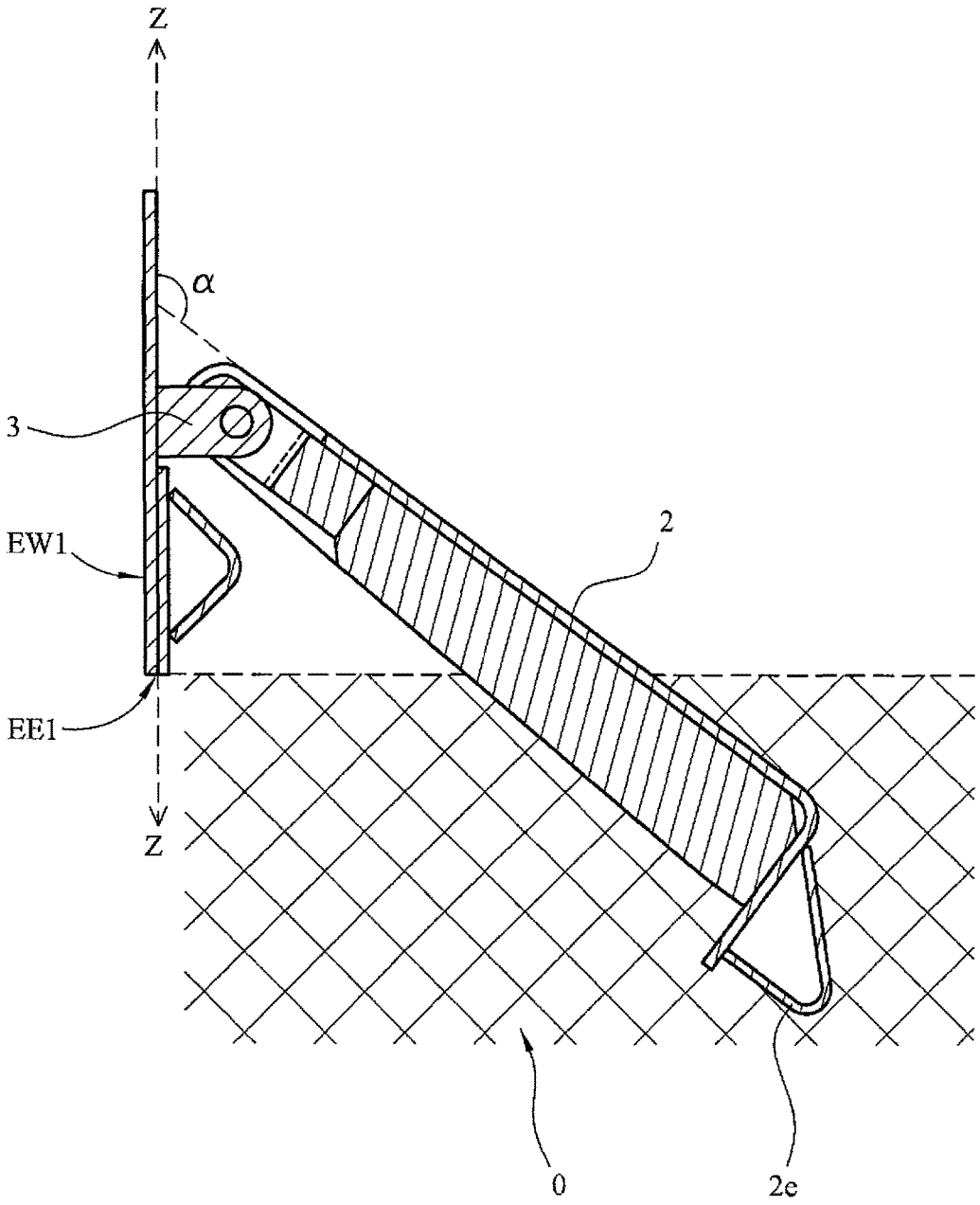
FIG. 2 depicts a cross-sectional view of the baffle of FIG. 1 mounted on a wall of a hopper.

FIG. 1 depicts an embodiment of a baffle according to the present invention. FIGS. 2 to 5 depict views of an embodiment of a hopper comprising the baffle of FIG. 1.

With reference to FIGS. 1 to 5, the baffle (1) comprises a panel body (2) that is configured to be mounted on a wall of the hopper adjacent to an edge of the outlet.

When mounted on the hopper wall, the panel can be arranged to project from the hopper wall in a generally downwardly direction beyond the edge of the outlet. In this projected position, the panel body forms a barrier (blockade, boundary wall) that extends downwardly from the edge of the outlet and across a region below the edge of the outlet. Therefore, as bulk commodities discharge from the outlet, the spread of bulk commodities in a direction beyond the panel is impeded. By restricting the spread of bulk commodities, the baffle reduces undesirable spillage. The baffle improves the volume of bulk commodities reaching a discharge region or receptacle. The baffle reduces the risk of operational problems caused by the spillage. The baffles limits the transfer of dust and particulates to the environment. The baffle reduces or eliminates the need for personnel to be present in the unloading location to clear spillage from the tracks.

The panel may be mounted on an external surface or on an internal surface of a hopper wall. In the embodiment depicted in FIGS. 1 to 5, an upper (proximal) edge (2*a*) of the panel is coupled to the internal surface of the hopper wall.

The panel may be configured to be mounted on a sidewall of the hopper, adjacent to a side edge of the outlet and to be arranged to project downwardly beyond the side edge of the outlet so as to form a barrier in a region below the side edge of the outlet that limits lateral spread of bulk commodities. Alternatively, the panel may be configured to be mounted on an end wall of the hopper, adjacent to an end edge of the outlet and arranged to extend downwardly beyond the end edge of the outlet so as to form a barrier in a region below the end edge of the outlet that limits longitudinal spread of bulk commodities. If the hopper is movable, the panel may be mounted on a trailing end edge of the outlet so as to form a barrier that limits trailing longitudinal spread. The panel may be mounted on a leading end edge of the outlet so as to form a barrier that limits leading longitudinal spread.

In the embodiment depicted in FIGS. 1 to 5, the panel of the baffle is mounted on a first end wall (EW1) of the hopper, adjacent to a first end edge of the outlet (EE1) and the panel can be arranged to extend downwardly beyond the first end edge of the outlet hopper so as to limit longitudinal spread of bulk commodities past the panel.

Given that bulk commodities can only be discharged from a hopper when the outlet is open, the baffle is preferably arranged and used in association with an outlet cover that opens and closes the outlet. The baffle may be used with any suitable type of outlet cover that does not conflict with the projecting profile of the baffle. The outlet cover may comprise one or more doors, where the or each door is moveable between an open position and a closed position.

When the outlet cover is arranged in the open position, the one or more doors are configured to extend in a direction away from the outlet such that the outlet is at least substantially open (unrestricted, exposed). As a result, the outlet is sufficiently uncovered to allow for the discharging of bulk commodities into a discharging region or receptacle. When the outlet cover is arranged in a closed position, the one or more doors are configured to extend across the length and width of the outlet so that the outlet is at least substantially covered (shut, obstructed). As a result, discharging from the outlet is at least substantially restricted. Any bulk commodities stored within the hopper are at least substantially concealed (enclosed) within the hopper.

The or each door may be driven to move between the open position and closed position using manual, automatic and/or semi-automatic actuating means.

Figure 3:
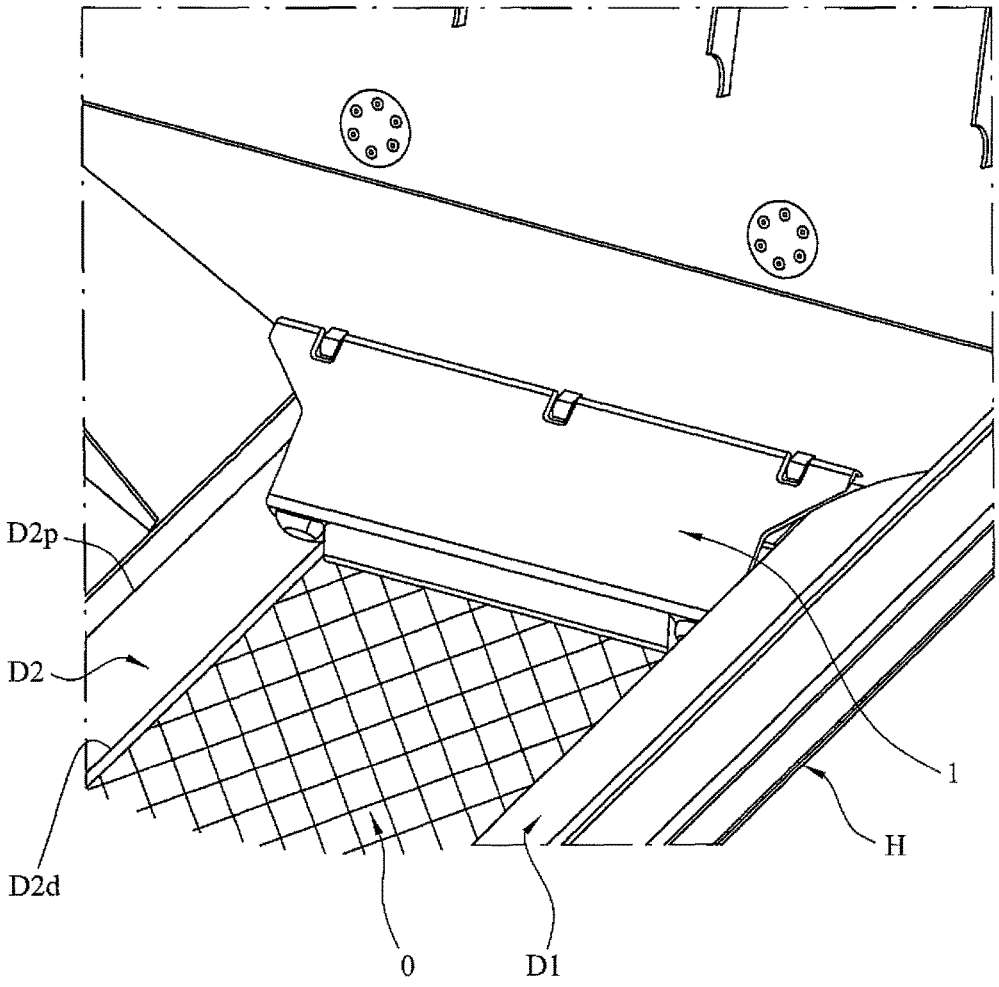
FIG. 3 depicts a perspective view of the baffle of FIG. 1 mounted in the hopper, where the baffle is arranged in a projected position and the opposing outlet doors are arranged in an open position.
Figure 4:
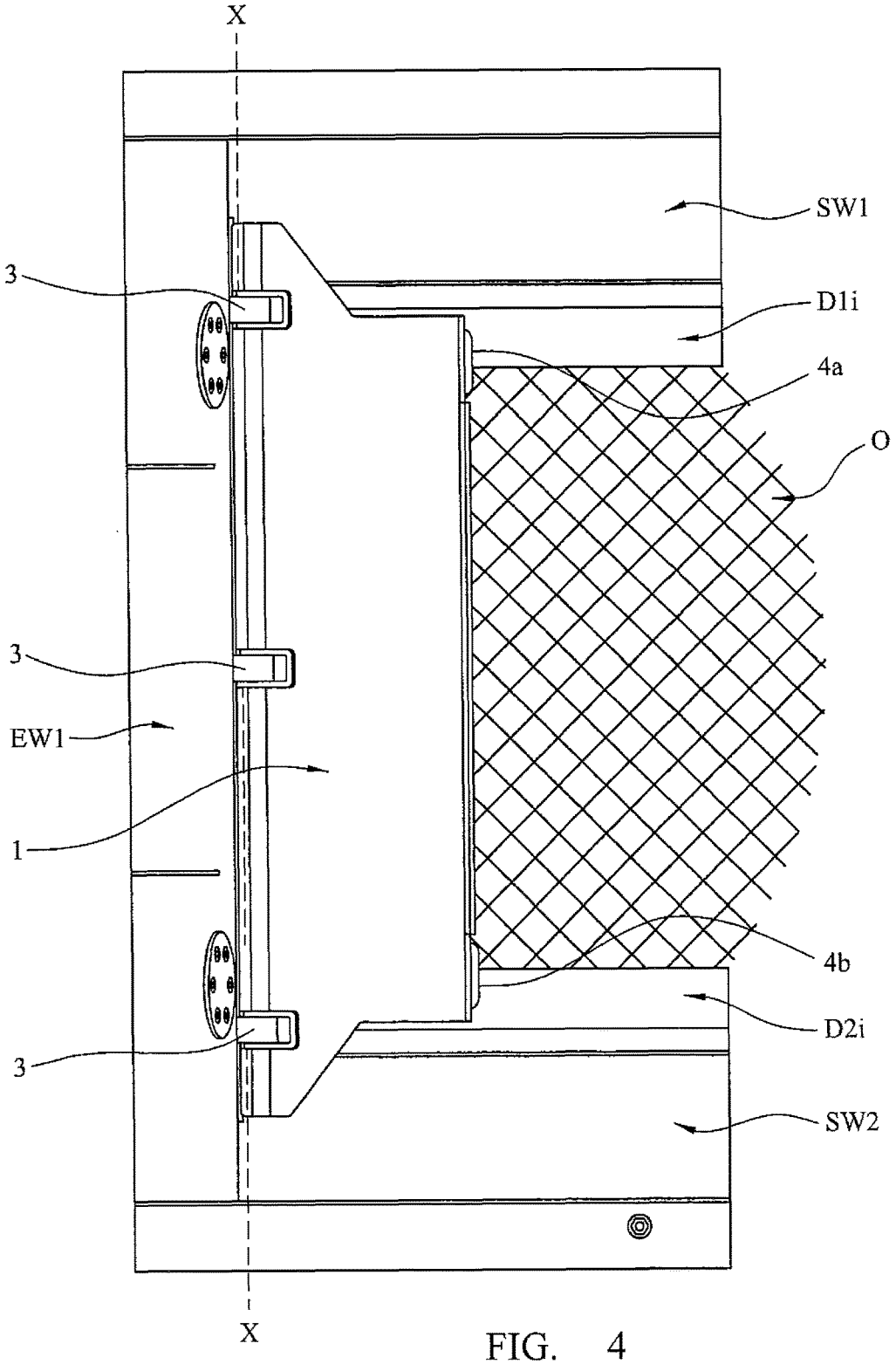
FIG. 4 depicts a plan view of the baffle mounted in a hopper as shown in FIG. 3.
Figure 5:
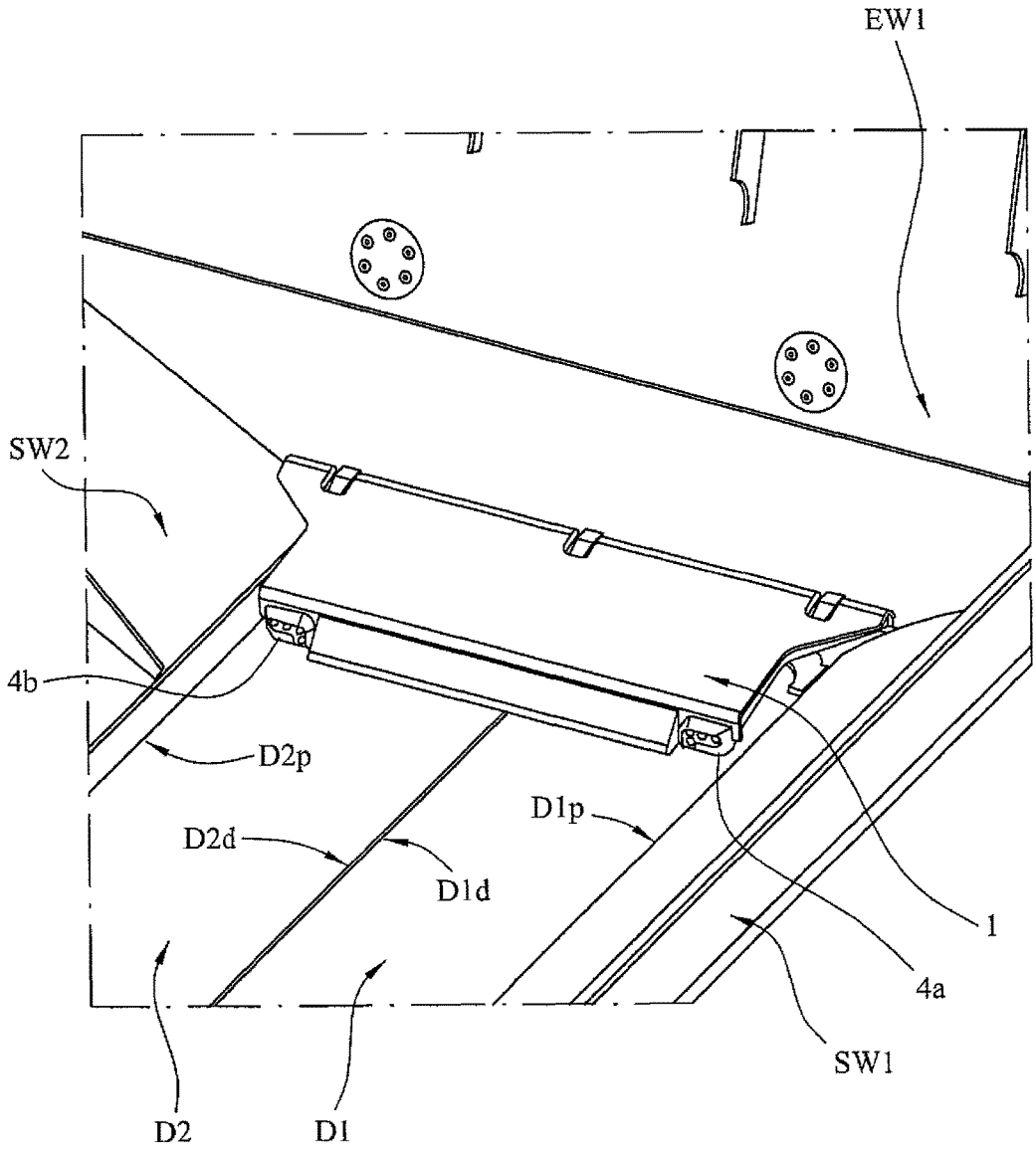
FIG. 5 depicts a perspective view of the baffle of FIG. 1 mounted in the hopper, where the baffle is arranged in a retracted position and the opposing outlet doors are arranged in a closed position.
Figure 6:
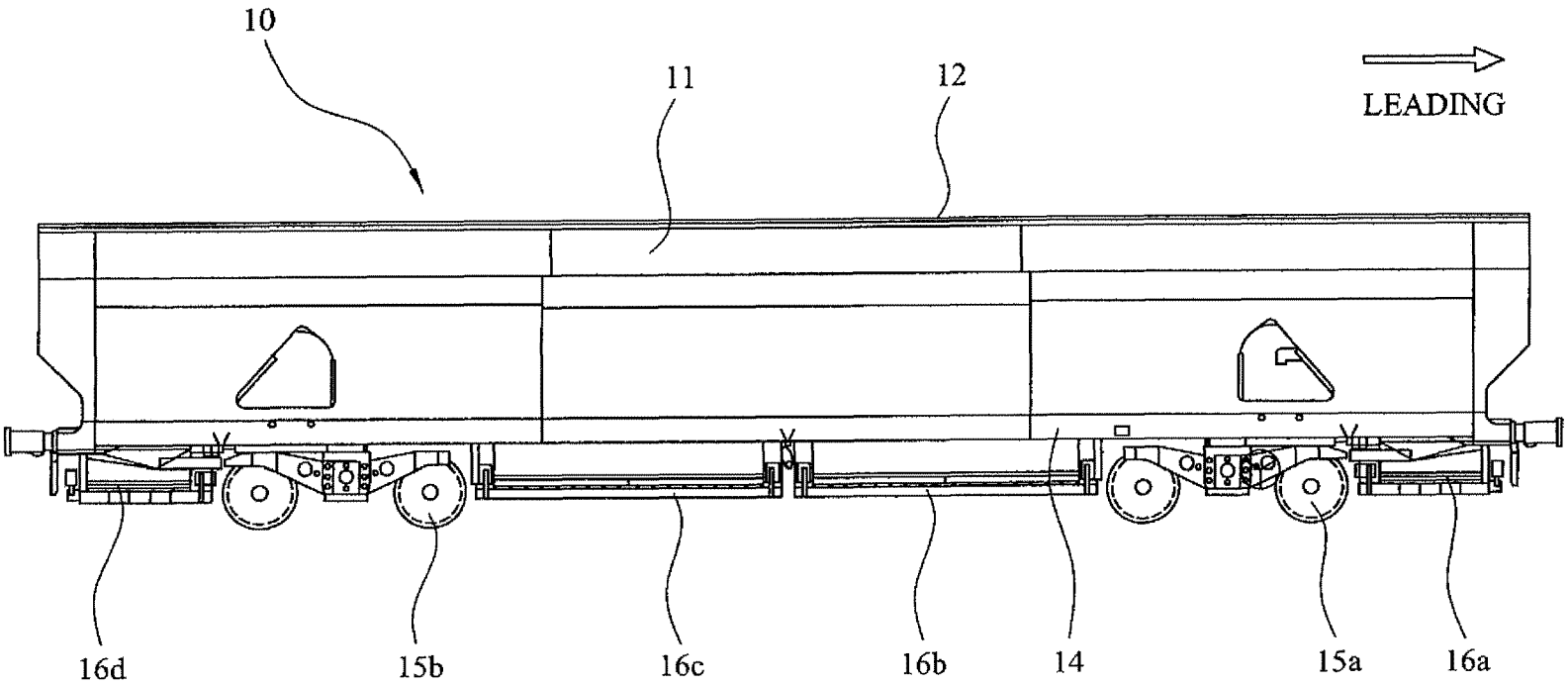
FIG. 6 depicts a side view of a hopper wagon according to an embodiment of the present invention.
Figure 7:
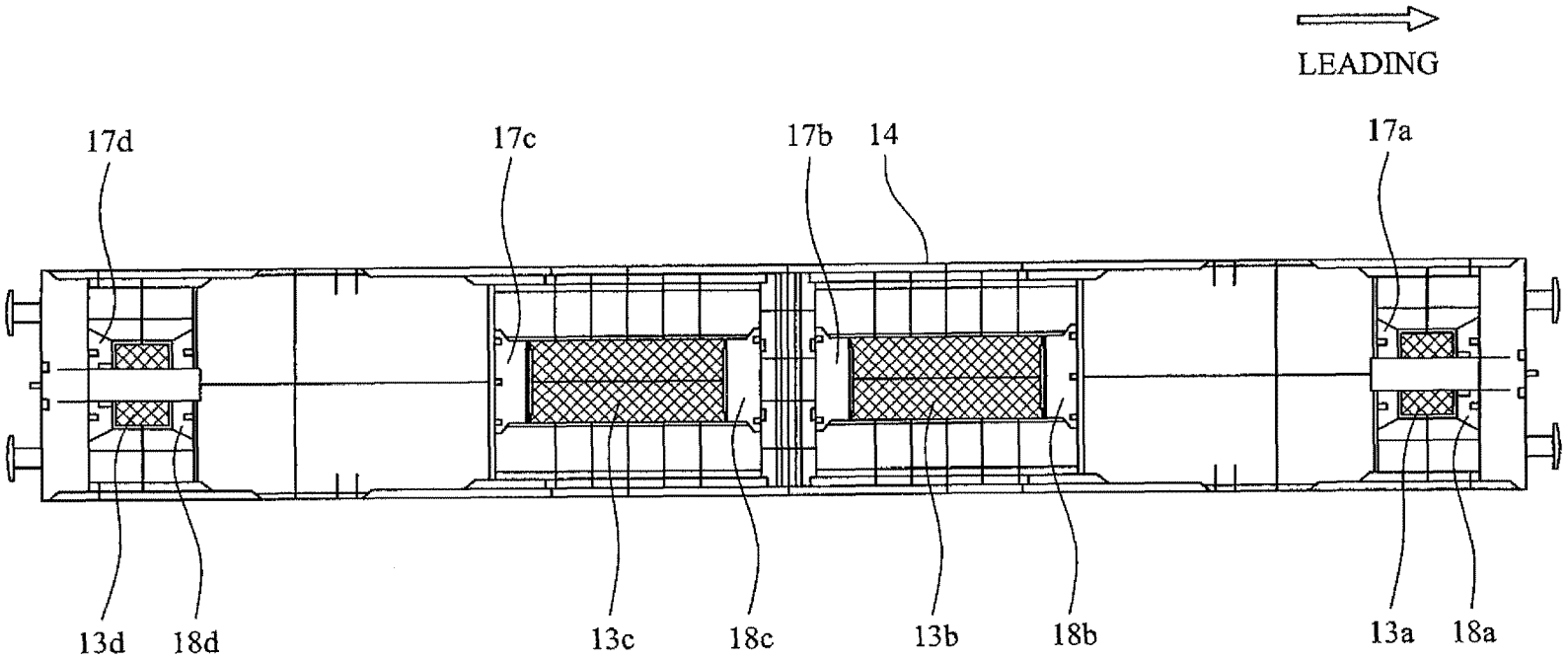
FIG. 7 depicts a top view of the hopper wagon of FIG. 6 showing the arrangement of the outlets.

The panel may be configured to project downwardly beyond an edge of the outlet and at least substantially across a gap space defined by the edge of the outlet and the open outlet cover. For example, in the embodiment depicted in FIGS. 1 to 5, the hopper comprises an outlet cover with an opposing pair of side doors (D1, D2) that are mounted such that their proximal edges (D1*p*, D2*p*) extend alongside the opposing side walls of the hopper (SW1, SW2) and are rotatable between an open position (where the doors extend in a generally downwardly direction and the outlet is substantially open as shown in FIGS. 3 and 4) and a closed position (where the distal edges (D1*d*, D2*d*) of the doors engage and the outlet is closed as shown in FIG. 5). When arranged in the projected position, the panel of the baffle preferably extends downwardly beyond the first end edge of the outlet and between the open opposing side doors thereby forming an obstruction that extends at least substantially across the gap space defined by the first end edge of the outlet (EE1) and the inner surfaces of the open doors (D1*i*, D2*i*). The panel is preferably configured to at least substantially conform with the cross-sectional profile of the open doors so as to enhance the barrier effect across the gap space between the open doors. In the embodiment depicted in FIGS. 1 to 5, sides edges (2*b*,2*c*) of the panel taper towards a lower edge (2*d*) so that the panel conforms with the respective inner surfaces of the opposing side doors and the barrier effect is optimised.

In the projected position, the panel may extend downwardly from the hopper wall at a first incline angle $\alpha$ relative to a vertical plane (ZZ). The panel may be configured to extend at an incline angle $\alpha$ towards the open door(s), and optionally form a mating contact with the door(s). The panel may be configured to extend at incline angle $\alpha$ towards a discharge region or receptacle located below the outlet and thereby advantageously guide the bulk commodities towards the discharge region or receptacle. Moreover, the panel may be inclined at an angle $\alpha$ to aid the flow of bulk commodities towards the discharge region or receptacle.

The panel may be permanently arranged (fixed) in the projected position. Preferably, the panel would be sited so as not to compromise the opening and closing action of the outlet cover. Alternatively, the panel may be movable between the projected position and a retracted position. The panel may be movable to the projection position when the outlet cover is in the open position and the panel may be movable to the retracted position when the outlet cover is in the closed position. In the retracted position, the panel is preferably arranged such that it is not usable and provides little or no barrier effect. When retracted, the panel may be arranged at least substantially above the edge of the outlet. In the retracted position, the panel may be inclined at a second incline angle β relative to the vertical plane (ZZ), whereby angle β<angle α (not shown). As shown in FIG. 5, the panel may be configured in the retracted position such that it extends relative to at least a part of the cover arranged in a closed position.

The panel may be rotatably mounted on the wall of the hopper so as to allow the panel to rotate between the projected (usable) position and the retracted (unusable) position. The baffle may comprise any suitable hinge means for rotatably mounting the panel on the hopper wall. In the embodiment depicted in FIGS. 1 to 5, the hinge means comprise hinge brackets (3) arranged intermittently across the hopper wall, adjacent to the edge of the outlet so as to form a horizontal axis (XX) about which the panel can rotate.

The baffle may be driven to move between the projected position and the retracted position using actuating means. The actuating means may be self-actuating means for inciting the movement of the panel. As shown in the embodiment depicted in FIGS. 1 to 5, the baffle may comprise self-actuating means that are configured to incite the rotation of the panel in response to the opening and closing of the outlet cover.

The self-actuating means may comprise slidable coupling means for slidably coupling the panel to one or both of the opposing side doors. The slidable coupling means is configured to drive the panel in a sliding action across one or both opposing outlet doors such that the panel rotates between the projected position and the retracted position as the opposing outlet doors rotate between an open position and a closed position respectively. The panel may be driven to slide along an arcuate path between a distal edge (D1*d*, D2*d*) and proximal edge (D1*p*, D2*p*) of the opposing outlet doors as the opposing outlet doors rotate between an open position and a closed position.

The slidable coupling means may comprise male or female slidable coupling means configured to slidably engage a corresponding female or male slidable coupling means of the outlet cover.

The slidable coupling means may comprise one or more low friction contact members mounted on the panel so as to form a slidable mating contact with the outlet cover.

The low friction contact members may comprise any suitable low friction material. The low friction contact members may comprise a hard wearing material. The low friction contact members may comprise a plastics, polymer or resin material. For example, the low friction contact member may comprise polytetrafluoroethylene (PTFE) or Devlon.

To help maintain the slidable mating contact between the panel and outlet cover, the outlet cover may comprise one or more elongate slot, groove, channel, ridge or aperture to receive the corresponding low friction contact member.

In the embodiment of the baffle depicted in FIGS. 1 to 5, the self-actuating means comprise a pair of low friction contact members (4*a*,4*b*) arranged at the lower corner regions of the panel/the ends of the distal edge of the panel. The contact members form a mating contact with the doors under the force of gravity. The first contact member (4*a*) slidably couples the panel with the inner surface of the first outlet door (D1*i*). The second contact member slidably couples the panel with the inner surface of the second outlet door (D2*i*). When the outlet doors are arranged in the open position, the contact members form a mating contact with a lower (distal) region of the doors. As the doors close, the contact members slide along the inner surfaces of the respective doors, following an arcuate path, until they reach an upper (proximal) region of the doors. The panel rotates upwardly about the hinge means as the contact members slide along the inner surfaces of the respective doors. When the doors are closed, the panel is arranged in a retracted position, extending from the hinge means in a generally transverse direction between the outlet and the closed doors.

The baffle and/or the outlet cover may comprise a stop to prevent the panel from rotating beyond a predetermined projected position. The baffle and/or the outlet cover may comprise a stop to prevent the panel from rotating beyond a predetermined retracted position.

The baffle may comprise a tip (2*e*) arranged to extend along at least a part of the lower edge of the panel. The tip may be provided so as to stiffen or reinforce the lower edge of the panel. The tip may be integrally formed or welded to the panel.

It will be understood that the dimensions of the baffle will depend upon the type of hopper, the size of the outlet, the outlet doors, distance from the outlet to the predetermined discharge location or receptacle, the discharge region or receptacle and/or the type of bulk commodity.

The length of the baffle (L) may fall within the range of approximately 200 mm to 500 mm. The width (W) of the baffle may fall within the range of approximately 750 mm to 1200 mm.

The inclined angle α may be selected from a range of approximately 120° to 140° with respect to the vertical axis ZZ, depending on the arrangement of the discharge region or receptacle, the type of bulk commodities, the flow characteristics of the bulk commodities, volume of bulk commodities being discharged and the load of bulk commodities acting on the panel. In the embodiment depicted in FIGS. 1 to 5, the panel extends at an incline angle α of approximately 125° with respect to vertical axis ZZ when it is arranged in the projected position.

The incline angle β may be selected from a range of approximately 98° to 110° with respect to the vertical axis ZZ, depending on the mounting arrangement of the panel and the type of actuating means. In the embodiment depicted in FIGS. 1 to 5, the panel extends at an incline angle β of approximately 96° with respect to the vertical plane ZZ when it is arranged in the retracted position.

The panel of the baffle may be formed from a metal material or any other material that has sufficient structural integrity. For example, the panel may be formed from sheet stainless steel.

The baffle may be fitted when manufacturing a hopper. Alternatively, the baffle may be retro-fitted to an existing hopper so as to improve the discharging process of bulk commodities.

FIGS. 6 to 13 depict views of an embodiment of a hopper wagon according to the present invention comprising discharge barriers to control the spread of bulk commodities as they discharge.

The hopper wagon may form part of a freight train comprising several such wagons, typically twenty five in number arranged to be moved by a locomotive in a leading direction (LEADING).

In this embodiment, the hopper wagon (10) comprises a hopper wagon body (11) with a hopper storage chamber for storing bulk commodities (not shown), an inlet (12) formed in the top of the hopper wagon panel through which the bulk commodities can be loaded into the chamber, four outlets (13*a*,13*b*,13*c*,13*d*) formed in the base of the hopper wagon panel through which the bulk commodities can be discharged from the chamber, an underframe (14) for supporting the hopper wagon body, a first bogie (15*a*) and a second bogie (15*b*) coupled to the underside of the underframe.

The hopper wagon further comprises a discharge system for controlling the discharging of the bulk commodities through the outlet. The discharge system comprises four outlet covers (16*a*, 16*b*,16*c*,16*d*) arranged in association with a respective outlet, actuating means for driving each outlet cover between an open position and a closed position, control means for controlling the actuating means, four trailing edge baffles (17*a*,17*b*,17*c*,17*d*) arranged in association with the trailing end edge of each respective outlet, four leading edge discharge barriers (18*a*,18*b*,18*c*, 18*d*) arranged in association with the leading end edge of each respective outlet. The trailing edge baffles and leading edge baffles are provided so as to limit the longitudinal spread of bulk commodities as the bulk commodities discharge through the outlets. The leading and trailing baffles have the same configuration as the baffle depicted in FIG. 1 and described with reference to FIGS. 2 to 5.

Figure 8:
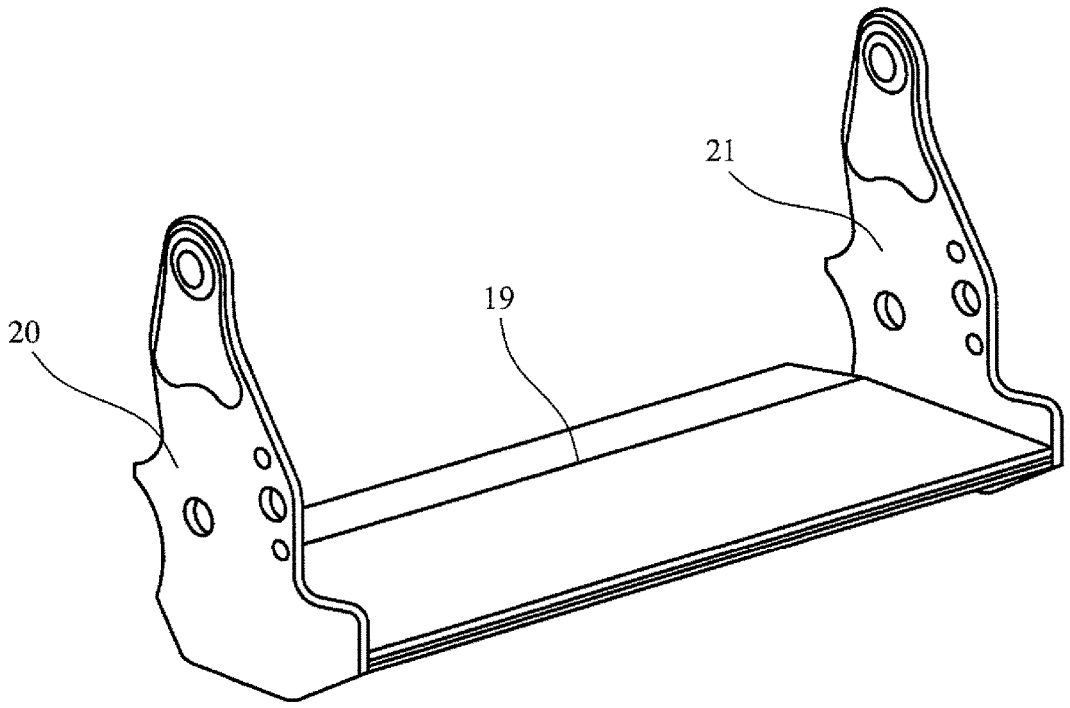
FIG. 8 depicts a perspective view of an outlet door of the hopper wagon of FIG. 6.

In the embodiment depicted in FIGS. 6 to 13, each outlet cover comprises an opposing pair of side doors (D1, D2) for opening and closing a respective outlet. The opposing pair of side doors are arranged on the underside of the respective outlet and extend the length of the outlet. Each door is rotatably such that the proximal edge (D1*p*, D2*p*) extends alongside a side wall of the hopper wagon, adjacent to a side edge of the outlet so that it can be rotated in a vertical plane about a horizontal axis. As shown in FIG. 8, each door comprises a central plate (19), a first end plate (20) and a second end plate (21). The central plates extend in a generally lateral direction between the upstanding end plates.

Figure 9A:
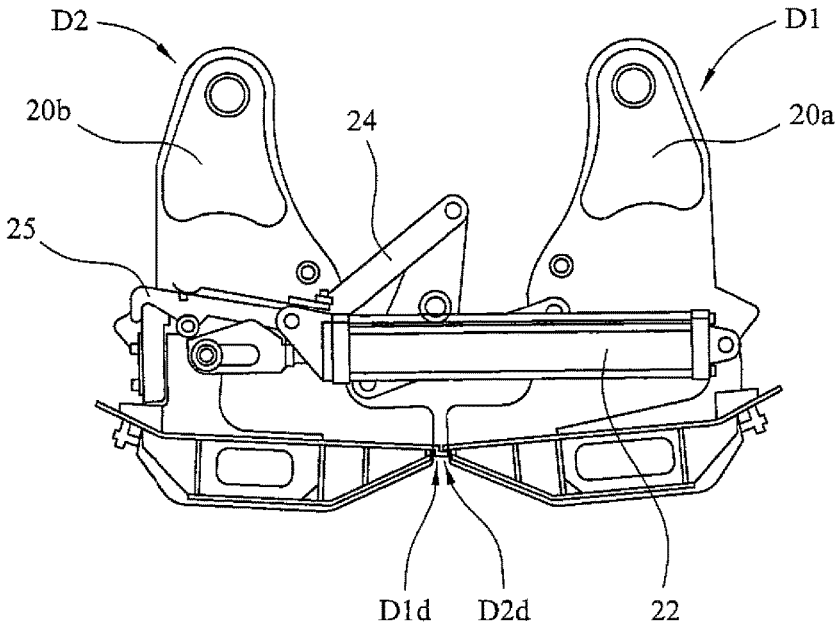
FIGS. 9A and 9B depict end views of an opposing pair of outlet doors and associated actuating means of the hopper wagon of FIG. 6, where the opposing pair of outlet doors are arranged in a closed position and an open position respectively.
Figure 9B:
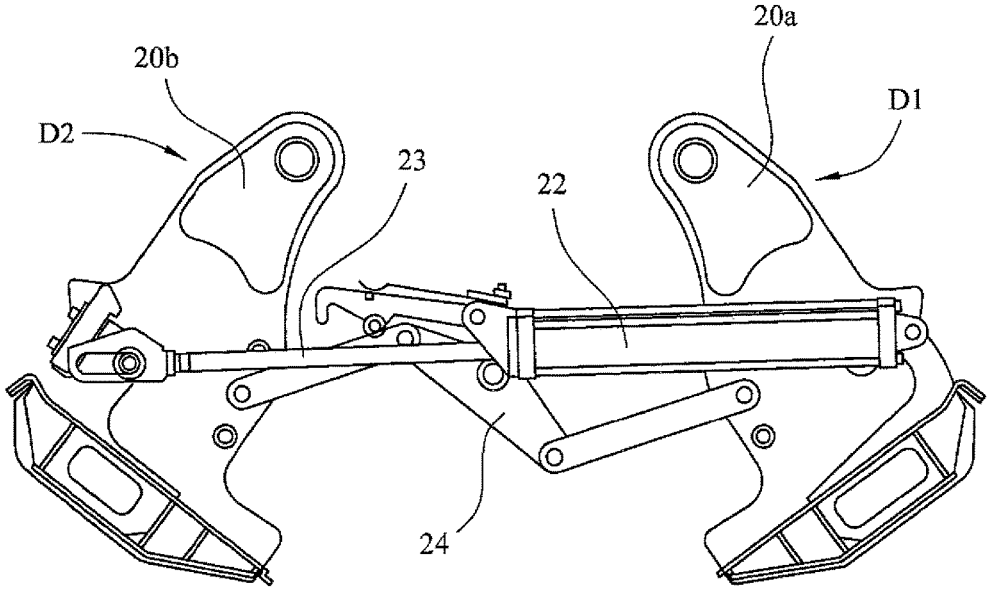

FIGS. 9A and 9B show the open and closed arrangement of the first end plates (20*a*,20*b*) for the opposing side doors. As can be seen in FIGS. 9A and 9B, the opposing pairs of side doors can be driven to rotate between an open and closed position by actuating means coupled to the first end plates and/or the second end plates of the side doors. In this embodiment, the actuating means acting on the first end plates comprise a double acting cylinder (22), piston (23) and an equaliser linkage (24). The cylinder and piston may be pneumatically or hydraulically controlled. The equaliser linkage is configured to equally and simultaneously transfer the force from the cylinder and piston to the opposing pair of doors such that the opposing pair of doors have the same range and rate of movement. FIG. 9A depicts the piston rod fully retracted in the cylinder. As a result, the opposing pair of doors are rotated towards one another about a vertical plane such that the central plates extend in a generally lateral direction across the outlet, the distal edges (D1*d*, D2*d*) of the central plates engage and the outlet is covered. FIG. 9B depicts the piston rod in the fully extended position from the cylinder. As a result, the opposing pair of doors are rotated away from the outlet about a vertical plane such that they extend in a generally downwardly direction towards the floor supporting the hopper wagon and the outlet is now open. The discharge barriers have been omitted from these drawings in the interests of simplicity.

The discharge system comprises control means for controlling the actuating means for each outlet cover. The discharge system may comprise automatic control means. Hence, the discharge system has an automatic mode of operation. The automatic control means may comprise sensors mounted on the hopper wagon that are activated by one or more a line side discharge activation devices (DADI) mounted on infrastructure at the discharging site. For example, automatic control means may open an outlet cover for an outlet when the sensor is activated by a first line side discharge activation device at the entry of the discharging bay and control the closing of the outlet cover when the sensor is activated by a second line side discharge activation device at the exit of the discharging bay. The automatic control means preferably opens the outlet covers of the hopper wagon in a sequential fashion as the hopper wagon passes over the unloading bay located between the rails and beneath the rail tracks.

The discharge system may comprise manual control means. Hence, the discharge system has a manual mode of operation. The manual control means may comprise user operated handles for the door. The manual control means may be configured to override the automatic control means, for example, during an emergency.

The discharge system may comprise locking means. The locking means may comprise means to lock the door in the open position. For example, the locking means may comprise means to continually provide air pressure in the cylinders so as to keep the cylinders and therefore the door in the open position. The locking means may comprise means to lock the door in the closed position. For example, the locking means may comprise a primary mechanical lock (25) connected to each cylinder that engages mechanically by the closing of the cylinder and is released mechanically by the opening of the cylinder. A secondary mechanical lock may be provided. The locking means may be configured to lock and unlock one or more doors of the hopper wagon.

The trailing edge baffle (17*a*,17*b*,17*c*,17*d*) for each respective outlet is rotatably mounted on a trailing wall of the hopper (TW) adjacent to the trailing edges of the outlet and slidably coupled to the inside surfaces (19*ia*, 19*bi*) of the first side door and second, opposing side door of the outlet cover for the outlet.

Likewise, the leading edge baffle (18*a*,18*b*,18*c*,18*d*) for each respective outlet is rotatably mounted on a leading wall (LW) adjacent to the leading edges of the outlet and slidably coupled to the inside surfaces (19*ai*, 19*bi*) of first side door and second, opposing side door of the outlet cover for the outlet.

The trailing edge baffle and leading edge baffle are slidably coupled to the first side door and second side door (D1, D2) using low friction contact means (4*a*,4*b*). As the first side door and second side door rotate, the contact means slide along the first side door and second side door. The sliding action causes the trailing edge baffle and leading edge baffle to rotate. Hence, the contact means remain in contact with the first side door and second side door as the first side door and second side door rotate between an open position and a closed position and the trailing edge baffle and the leading edge baffle rotate between a projected position and retracted position.

Figure 10:
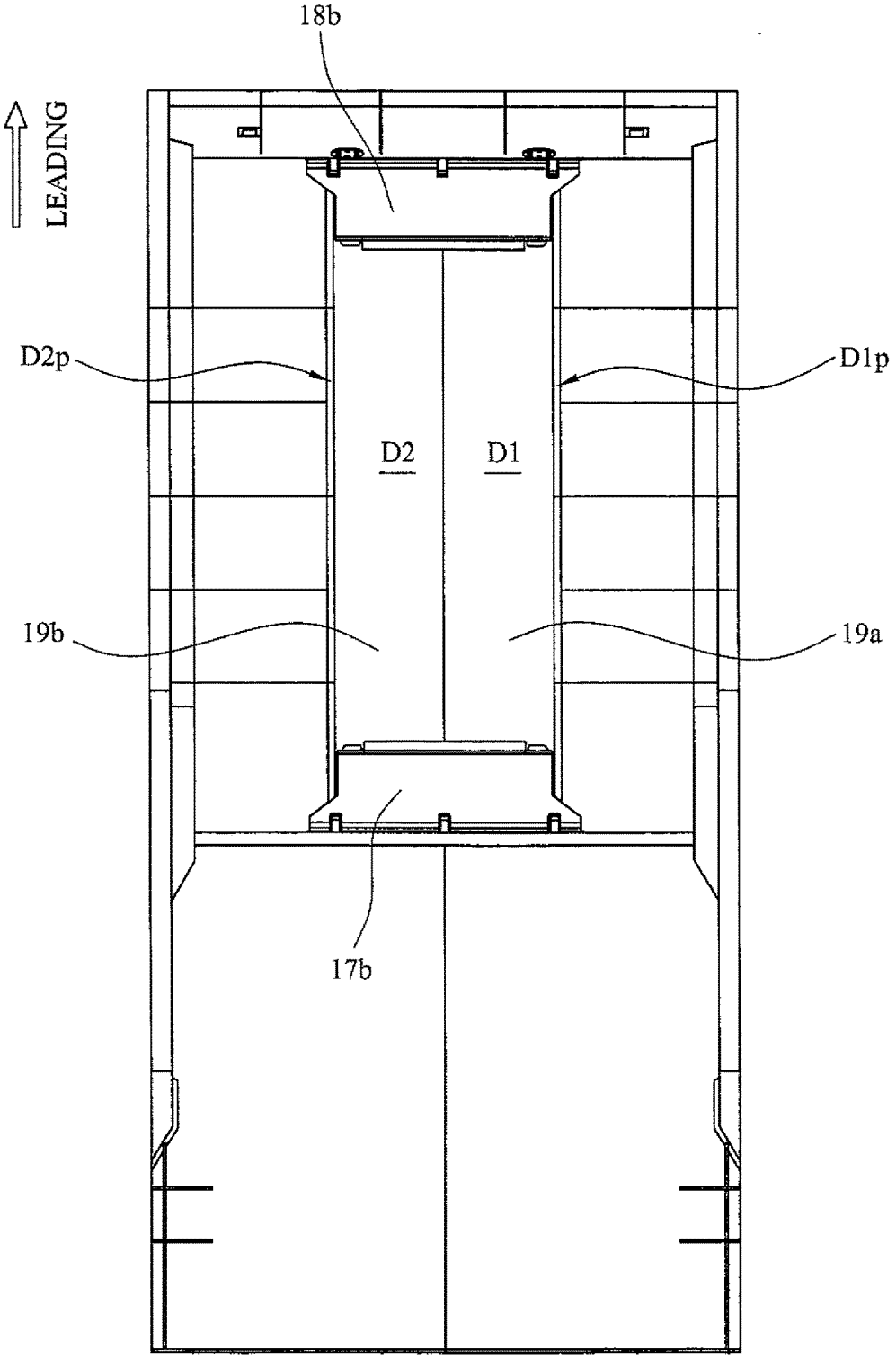
FIG. 10 depicts a plan view of a central outlet of the hopper wagon of FIG. 6, where the leading and trailing discharge barriers are arranged in a retracted position and the opposing outlet doors are arranged in a closed position.
Figure 11:
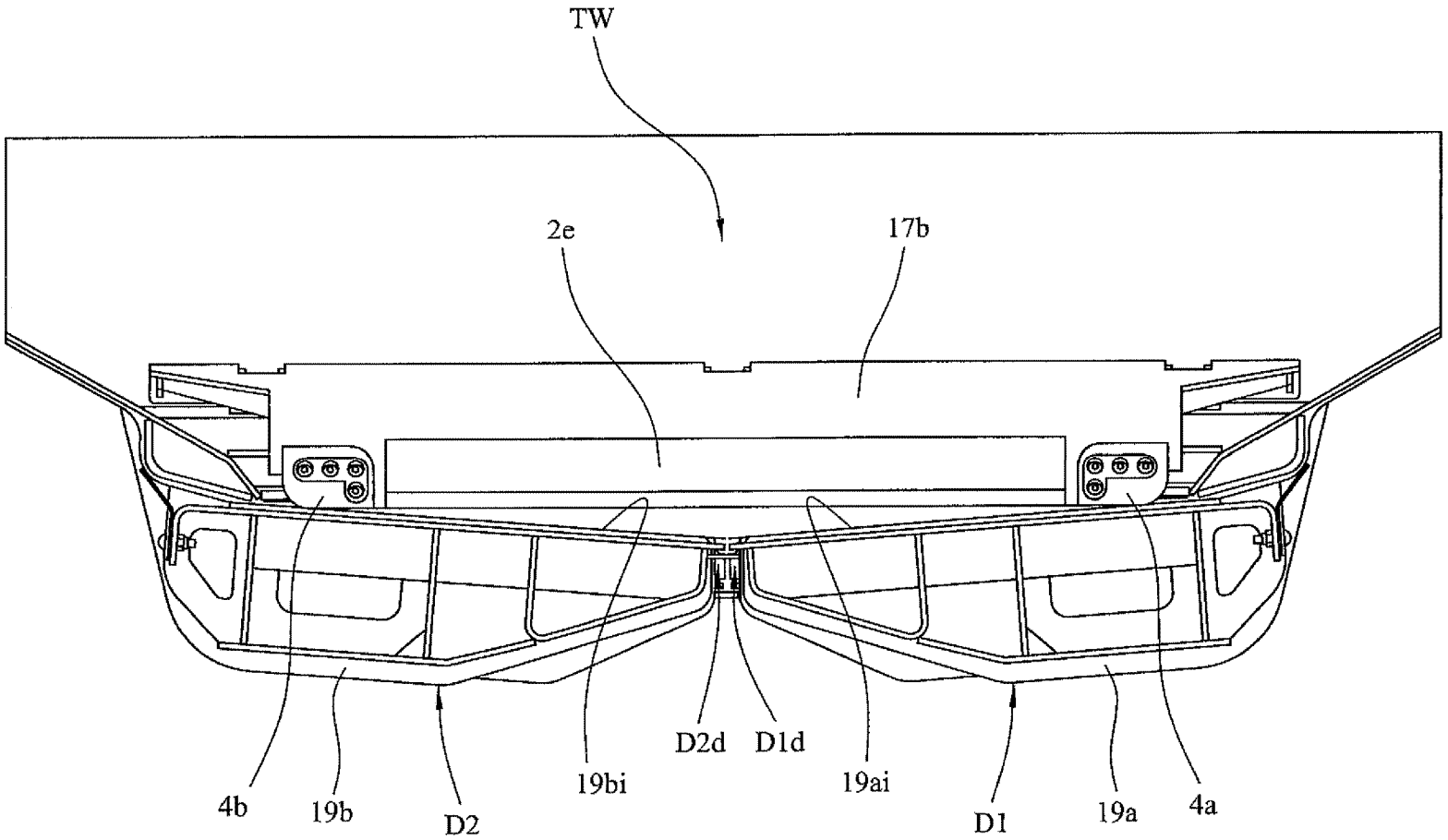
FIG. 11 depicts a cross-sectional view of the central outlet as shown in FIG. 10.

FIGS. 10 and 11 depict plan and cross-sectional views of a central outlet 13*b*,where the opposing side doors (see central sections 19*a*,19*b*) are arranged in a closed position, and the baffles (17*b*,18*b*) are arranged in a retracted position extending between the outlet and the closed side doors. It can be seen that the low friction slidable coupling members (4*a*,4*b*) are arranged in slidable mating contact with the inner surfaces (19*ai*, 19*bi*) of the central sections of the opposing side doors. The closing action of the opposing side doors drives the slidable coupling members (and therefore the baffles) in a sliding action towards the proximal edges of the opposing side doors and initiates the rotation of the baffles to the retracted positions.

Figure 12:
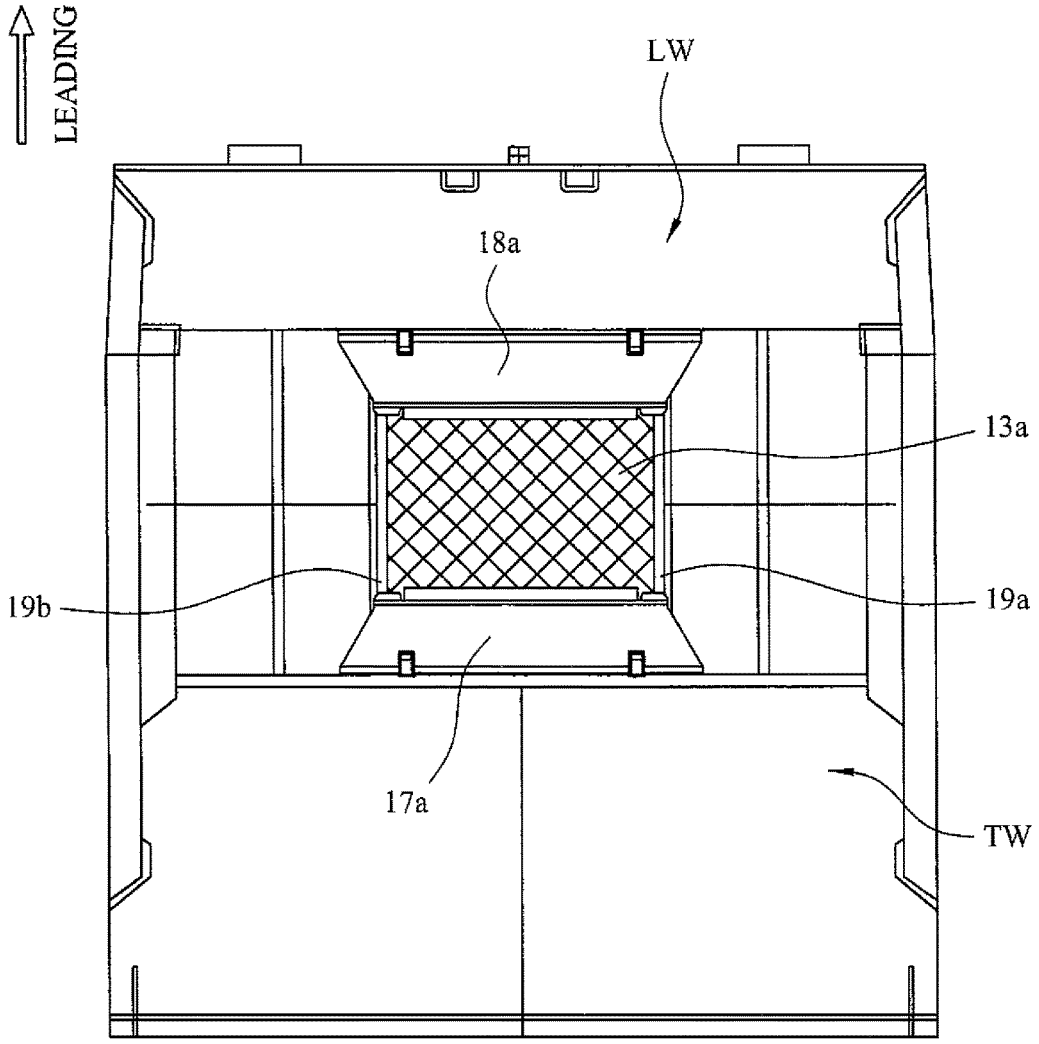
FIG. 12 depicts a plan view of an end outlet of the hopper wagon of FIG. 6, where the leading and trailing discharge barriers are arranged in a projected position and the opposing outlet doors are arranged in an open position.
Figure 13:
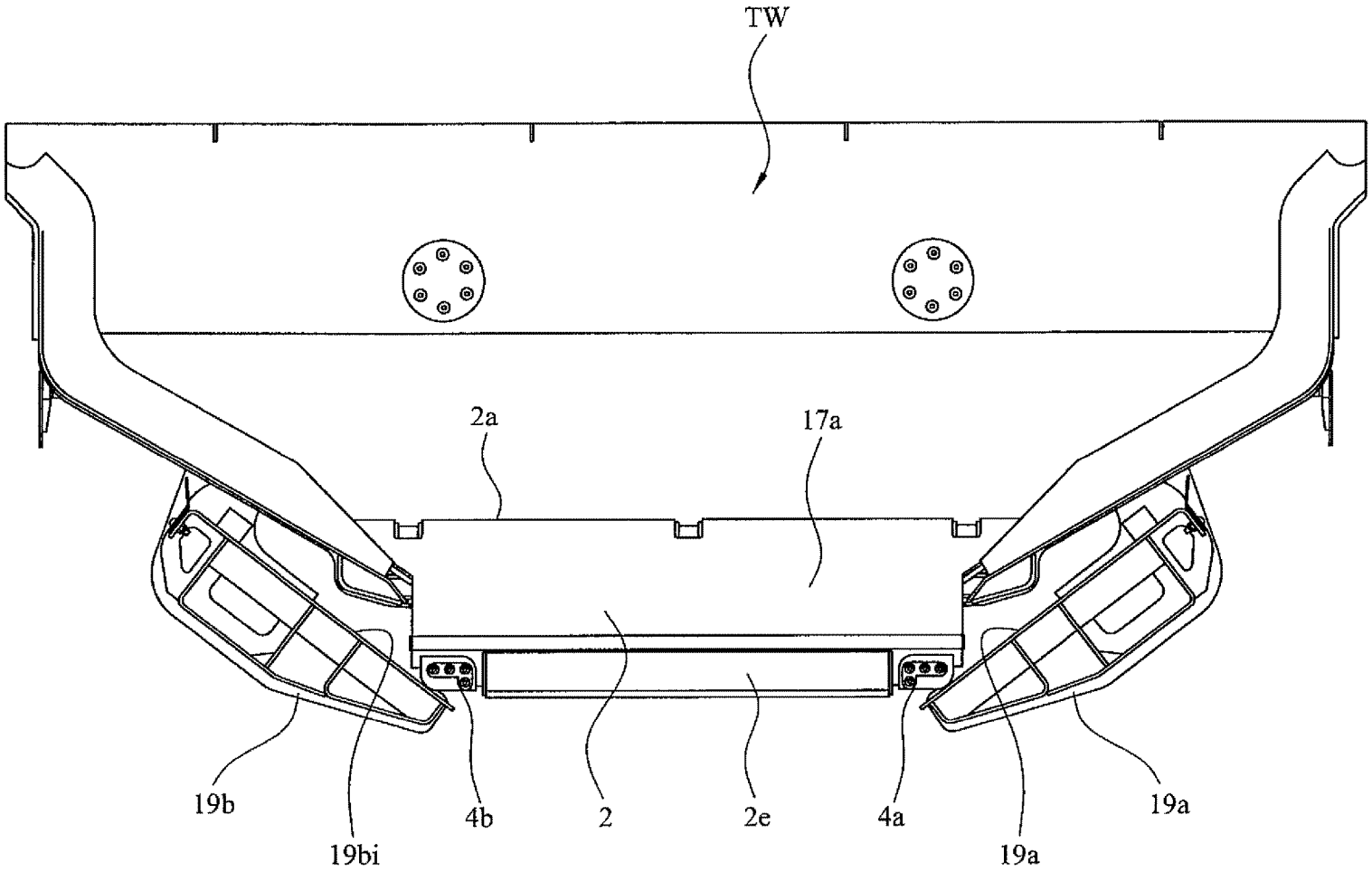
FIG. 13 depicts a cross-sectional view of the end outlet as shown in FIG. 12.

FIGS. 12 and 13 depict plan and cross-section views of an outer outlet 13*a*,where the opposing side doors (see central sections 19*a*,19*b*) are arranged in an open position and the baffles (17*a*, 18*a*) are arranged in a projected position extending from the trailing and leading walls in a downwardly direction beyond the trailing and leading edges. It can be seen that the low friction slidable coupling members (4*a*,4*b*) are arranged in slidable mating contact with the inner surfaces (19*ai*, 19*bi*) of the central sections of the opposing side doors. As the opposing side doors open, the slidable coupling members (and thereby the baffles) slide under the force of gravity towards the distal edges of the opposing side doors. The sliding action subsequently causes the baffles to rotate to their respective projected positions.

When arranged in the open position/projected position, the opposing side doors, the trailing edge baffle and the leading edge baffle extend downwardly and form a chute extending towards a region between the rails of a railway track. As bulk commodities discharge through the outlet, the opposing side doors limit the lateral spread of bulk commodities outside the unloading bay. The trailing edge baffle and the leading edge baffle minimise the longitudinal spread of bulk commodities outside the unloading bay.

Indeed, when the hopper wagon is moved across an unloading bay arranged between the railway tracks, the opposing side doors, trailing edge baffle and leading edge baffle are preferably configured to form a chute that guides discharging bulk commodities towards the unloading bay.

If spillage has occurred or the unloading bay has been overfilled, the trailing baffle and optionally the leading baffle help to plough the bulk commodities so as to move or diminish the amount of bulk commodities from key regions of the railway track.

Whilst endeavouring in the foregoing specification to draw attention to those features of the invention believed to be of particular importance, it should be understood that the applicant claims protection in respect of any patentable feature or combination of features referred to herein, and/or shown in the drawings, whether or not particular emphasis has been placed thereon.

Throughout the description and claims of this specification, the words "comprise" and "contain", and any variations of the words, means "including but not limited to" and is not intended to (and does not) exclude other features, elements, components, integers or steps.

Throughout the description and claims of this specification, the singular encompasses the plural unless the context requires otherwise. In particular, where the indefinite article is used, the specification is to be understood as contemplating plurality as well as singularity, unless the context requires otherwise.

Features, integers or characteristics described in conjunction with a particular aspect, embodiment or example of the invention are to be understood to be applicable to any other aspect, embodiment or example described herein unless incompatible therewith.

The invention claimed is:

1. A discharge system for controlling the discharge of a load through an outlet in a hopper, whereby the discharge system comprises:

a cover comprising a first side door and an opposing second side door, whereby the opposing side doors are rotatable between an open position, where the outlet is substantially open and a closed position where the outlet is substantially closed;

actuating means for driving the first side door and second side door between the open position and the closed position;

a first spillage barrier rotatably mounted to a first end edge of the outlet and slidably coupled to the first side door and the second side door;

whereby, the first spillage barrier is driven to slide along the first side door and second side door and thereby rotate between a projected position and a retracted position as the first door and second door are driven to rotate by the actuating means between the open position and the closed position respectively.

2. A discharge system according to claim 1, wherein the first spillage barrier comprises a baffle comprising a panel body that is mountable on a wall of a hopper adjacent an edge of an outlet of a hopper and, whereby in use, is arrangeable in a projecting position, to project in a generally downwardly direction beyond the edge of the outlet so as to restrict the spread of bulk commodities past the panel body as the bulk commodities discharge through the outlet.

3. A discharge system according to claim 2, wherein the panel body is mountable on a sidewall of the hopper adjacent to a side edge of the outlet and is arrangeable in the projected position to project in a generally downwardly direction beyond the side edge of the outlet so as to restrict lateral spread of bulk commodities past the panel body as the bulk commodities discharge from the outlet.

4. A discharge system according to claim 2, wherein the panel body is mountable on an end wall of the hopper adjacent to an end edge of the outlet and is arrangeable in the projected position to project in a generally downwardly direction beyond the end edge of the outlet so as to restrict longitudinal spread of bulk commodities past the panel body as the bulk commodities discharge from the outlet.

5. A discharge system according to claim 2, wherein the panel body is arrangeable in the projected position to project in a generally downwardly direction beyond the edge of the outlet and between a gap space defined by the edge of the outlet and an outlet cover arranged in an open position.

6. A discharge system according to claim 2, wherein the panel body is arrangeable in the projected position to project at a first incline angle $\alpha$ that falls in the range of approximately 120° to 140° with respect to a vertical axis.

7. A discharge system according to claim 2, wherein the baffle comprises rotatable mounting means for rotatably mounting the panel body on the wall of the hopper such that the panel body is movable between the projected position and a retracted position, where the panel body is arranged in a stowed configuration.

8. A discharge system according to claim 7, wherein the baffle comprises drive means to drive the panel body between the projected position and the retracted position.

9. A discharge system according to claim 8, wherein the drive means are self-actuating means and the self-actuating means are optionally configured to incite the rotation of the panel body between the projected position and the retracted position as the outlet cover moves between an open position and a closed position respectively.

10. A discharge system according to claim 9, wherein the self-actuating means comprise slidable coupling means for slidably coupling the panel body to the outlet cover and optionally the slidable coupling means comprise one or more low friction contact members mounted on a lower edge and/or side edge of the panel body and arranged in mating contact with the outlet cover.

11. A discharge system according to claim 2, wherein the baffle comprises a stiffening tip arranged along a lower edge of the panel body.

12. A discharge system according to claim 2 for controlling the discharge of bulk commodities through an outlet of a hopper comprising:

an outlet cover arrangeable on the underside of the outlet and movable between a closed position, where the outlet is substantially closed and an open position, where the outlet is substantially open;

wherein the baffle is arrangeable in use to restrict the spread of bulk commodities in a direction beyond the baffle as bulk commodities discharge through the open outlet cover.

13. A hopper comprising:

a chamber for storing bulk commodities;

an inlet through which bulk commodities can be loaded into the chamber; and a discharge system according to claim 1.

14. A hopper wagon comprising:

hopper wagon body comprising a chamber for storing bulk commodities;

an inlet formed in the top of the body and through which bulk commodities can be loaded into the chamber; and a discharge system according to claim 1.

15. A hopper wagon according to claim 14, wherein the or each outlet cover comprises an opposing pair of doors for the outlet, whereby the opposing pair of doors are arranged on opposing hopper walls and are rotatable between an open position where the doors extend from the opposing hopper walls in a generally downwardly direction and a closed position, where distal edges of opposing walls engage and the outlet is thereby closed.

16. A hopper wagon according to claim 15, wherein the actuating means comprise a cylinder, a piston and an equaliser linkage to drive the opposing pair of doors between the closed position and the open position.

17. A hopper wagon according to claim 16, wherein the control means are automatic control means configured to sequentially open and close the outlet covers as the outlets pass over an unloading bay.

* * * * *